US009179743B2

(12) United States Patent
Momose et al.

(10) Patent No.: US 9,179,743 B2
(45) Date of Patent: Nov. 10, 2015

(54) SNAP FASTENER

(75) Inventors: Makoto Momose, Tokyo (JP); Hiroyuki Sugiyama, Tokyo (JP); Yasufumi Morita, Nagoya (JP); Hideo Yogou, Otsu (JP); Hideshi Okamoto, Tokyo (JP)

(73) Assignees: YKK Corporation, Tokyo (JP); Toray Industries, Inc., Tokyo (JP)

( * ) Notice: Subject to any disclaimer, the term of this patent is extended or adjusted under 35 U.S.C. 154(b) by 0 days.

(21) Appl. No.: 14/112,427

(22) PCT Filed: Apr. 9, 2012

(86) PCT No.: PCT/JP2012/059680
§ 371 (c)(1),
(2), (4) Date: Oct. 17, 2013

(87) PCT Pub. No.: WO2012/144367
PCT Pub. Date: Oct. 26, 2012

(65) Prior Publication Data

US 2014/0041165 A1 Feb. 13, 2014

(30) Foreign Application Priority Data

Apr. 21, 2011 (JP) ..... 2011-094712

(51) Int. Cl.
*A44B 17/00* (2006.01)

(52) U.S. Cl.
CPC ..... *A44B 17/0029* (2013.01); *Y10T 24/45* (2015.01)

(58) Field of Classification Search
CPC ..... A44B 17/0035; A44B 17/0011; A44B 17/0052; A44B 17/0082; A44B 17/0088; A44B 17/0029; F16B 21/073; F16B 21/078; Y10T 24/45
USPC ..... 24/572.1, 671, 681, 689
See application file for complete search history.

(56) References Cited

U.S. PATENT DOCUMENTS

| | | | | | |
|---|---|---|---|---|---|
| 2,668,340 | A | * | 2/1954 | Jones | 24/681 |
| 2,799,910 | A | * | 7/1957 | Weber | 24/681 |
| 2,851,756 | A | * | 9/1958 | Jones | 24/692 |
| 3,466,714 | A | * | 9/1969 | Nysten | 24/689 |
| 4,847,959 | A | * | 7/1989 | Shimada et al. | 24/671 |
| 5,736,216 | A | * | 4/1998 | Shibahara et al. | 428/99 |

(Continued)

FOREIGN PATENT DOCUMENTS

| | | | |
|---|---|---|---|
| JP | 61-250055 | A | 11/1986 |
| JP | H 08-173214 | A | 7/1996 |

(Continued)

OTHER PUBLICATIONS

International Search Report dated Jul. 10, 2012, application No. PCT/JP2012/059680.

(Continued)

*Primary Examiner* — Robert J Sandy
*Assistant Examiner* — David Upchurch
(74) *Attorney, Agent, or Firm* — RatnerPrestia

(57) ABSTRACT

Provided is a resin snap fastener, which has excellent heat resistance, rigidity and toughness, and reduced decrease in rigidity when absorbing water, and which does not emit endocrine disrupters. The snap fastener is obtained by molding a resin composition comprising 45-100 parts by weight of wollastonite with respect to 100 parts by weight of a polyamide resin.

3 Claims, 1 Drawing Sheet

(56) References Cited

U.S. PATENT DOCUMENTS

| | | | | |
|---|---|---|---|---|
| 5,852,165 | A * | 12/1998 | Tsumiyama et al. | 528/332 |
| 5,933,929 | A * | 8/1999 | Kawakami et al. | 24/681 |
| 6,170,129 | B1 * | 1/2001 | Pferdehirt | 24/108 |
| 6,199,248 | B1 | 3/2001 | Akashi et al. | |
| 6,260,240 | B1 | 7/2001 | Akashi et al. | |
| 6,391,956 | B1 * | 5/2002 | Horio et al. | 524/314 |
| 6,485,806 | B1 * | 11/2002 | Tateyama et al. | 428/36.9 |
| 7,867,625 | B2 * | 1/2011 | Urata et al. | 428/639 |
| 2006/0052492 | A1 * | 3/2006 | Harashina et al. | 524/100 |
| 2006/0247332 | A1 * | 11/2006 | Coffey et al. | 523/351 |
| 2007/0054998 | A1 * | 3/2007 | Harashina | 524/189 |
| 2007/0123617 | A1 * | 5/2007 | Harashina | 524/189 |
| 2009/0062431 | A1 * | 3/2009 | Nasr et al. | 524/8 |
| 2011/0105683 | A1 * | 5/2011 | Kato et al. | 524/607 |

FOREIGN PATENT DOCUMENTS

| | | | |
|---|---|---|---|
| JP | 11-032815 | A | 2/1999 |
| JP | 2001-131407 | A | 5/2001 |
| JP | 2002-284985 | A | 10/2002 |
| JP | 2003-235611 | A | 8/2003 |
| JP | 2004-267279 | A | 9/2004 |
| JP | 2007-007238 | A | 1/2007 |

OTHER PUBLICATIONS

Jia Juan Hua, "Study on Reinforcing and Modifying of Nylon66 and its Properties of Hydrolyzing Resistance", Process Science and Technology, vol. 1, 12$^{th}$ stage, pp. B016-B094 (2006).

* cited by examiner

SNAP FASTENER

CROSS REFERENCE TO RELATED APPLICATIONS

This is the U.S. National Phase application of PCT/JP2012/059680, filed Apr. 9, 2012, and claims priority to Japanese Patent Application No. 2011-094712, filed Apr. 21, 2011, the disclosures of both applications being incorporated herein by reference in their entireties for all purposes.

FIELD OF THE INVENTION

The present invention relates to a snap fastener for use as an engagement tool for clothes and the like which consists mainly of a male member and a female member.

BACKGROUND OF THE INVENTION

The snap fasteners consisting mainly of a male member and a female member that have been proposed so far include one that has caps combined with a socket/stud having a caulking leg provided at the center of each cap. To attach a snap fastener to pieces of fabric, each caulking leg is pressed through each piece of fabric and its end is inserted through the insertion hole bored in the center of the socket or stud to hold the fabric between the cap and the socket/stud and then fix them by punching for caulking the end of each caulking leg (see, for instance, patent documents 1 and 2). The snap fasteners consisting mainly of a male member and a female member that have been proposed so far also include taped fasteners made of synthetic resin produced by molding them on both sides of tape (see, for instance, patent document 3). These snap fasteners are required to have a moderate degree of stiffness and toughness. In particular, the sockets and studs, which are fastened and unfastened repeatedly, must have a proper degree of toughness. In addition, a cap provided with a caulking leg must have a stiffness required to penetrate fabric and a toughness required to deform without suffering from cracking when caulked.

To meet these required characteristics, plastic fasteners made of polyacetal resin have been proposed (see, for instance, patent document 4). However, polyacetal resin softens at a low temperature of about 170° C., causing some problems when, for instance, ironed at a high temperature. The resin may also cause environmental problems because it is likely to release environmental hormones in some processing steps. There have been other investigations proposing taped fasteners that are made of polyamide resin from the viewpoint of heat resistance (see, for instance, patent documents 5 to 6). Although high in heat resistance, polyamide resin is low in stiffness and toughness, leading to molding products that are likely to suffer from stiffness deterioration when absorbing water.

PATENT DOCUMENTS

Patent document 1: Japanese Unexamined Patent Publication (Kokai) No. H08-173214
Patent document 2: U.S. Pat. No. 5,933,929
Patent document 3: U.S. Pat. No. 6,260,240
Patent document 4: Japanese Unexamined Patent Publication (Kokai) No. 2004-267279
Patent document 5: U.S. Pat. No. 6,199,248
Patent document 6: Japanese Unexamined Patent Publication (Kokai) No. 2007-7238

SUMMARY OF THE INVENTION

The present invention aims to solve the problem in providing a resin snap fastener that is high in heat resistance, stiffness, and toughness, as well as small in stiffness deterioration attributable to water absorption, and does not release environment hormones.

As a result of intensive studies aiming to solve such problems with resin-based snap fasteners, the present inventors have found that the type and quantity of the inorganic filler contained in the resin composition are important. Specifically, the snap fastener according to an exemplary embodiment of the present invention is produced by molding a resin composition containing 45 to 100 parts by weight of wollastonite per 100 parts by weight of polyamide resin.

The present invention serves to provide a resin snap fastener that is high in heat resistance, stiffness, and toughness, as well as small in stiffness deterioration attributable to water absorption, and does not release environment hormones, because of being produced by molding a resin composition containing 45 to 100 parts by weight of wollastonite per 100 parts by weight of polyamide resin. In particular, a snap fastener with improved handleability and durability can be produced by using a highly tough socket and stud, which are fastened and unfastened repeatedly, and caps having a caulking leg that has a high stiffness required to penetrate fabric and a high toughness required to deform without cracking when caulked.

BRIEF DESCRIPTION OF THE DRAWINGS

FIG. 1A illustrates the female member, and FIG. 1B illustrates the male member.

DETAILED DESCRIPTION OF EMBODIMENTS OF THE INVENTION

Figure 1A:
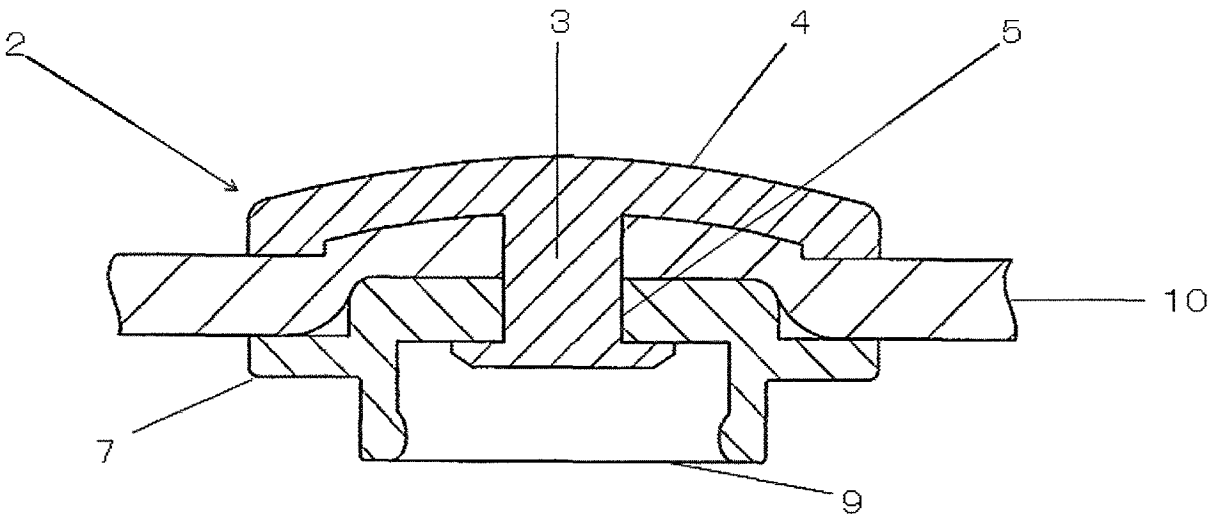
FIGS. 1A and 1B give cross sections of an embodiment of the snap fastener according to the present invention that comprising a male member and a female member.
Figure 1B:
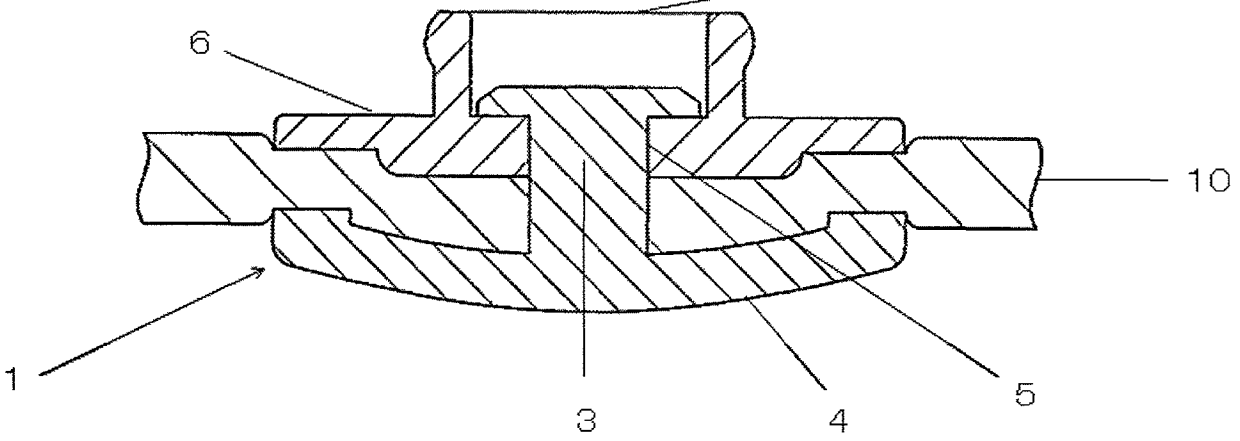

The snap fastener according to embodiments of the present invention is produced by molding a resin composition comprising polyamide resin (A) and inorganic filler (B) that contains wollastonite (B1), along with other components if necessary. In FIGS. 1A and 1B, the snap fastener consists of a male member 1 and a female member 2. The male member 1 has a stud 6 and a cap 4, which are normally produced separately by injection molding. The female member 2 has a socket 7 and a cap 4, which are normally produced separately by injection molding. Each cap 4 that forms part of the male member 1 or the female member 2 has a caulking leg 3 at its center. The stud 6 and the socket 7 each have an insertion hole 5 at the center through which a caulking leg 3 is inserted. The stud 6 has an engaging part 8 while the socket 7 has a partner engaging part 9. The engaging part 8 of the stud 6 is designed to engage with the partner engaging part 9 of the socket 7. For their engagement, the engaging part 8 and/or the partner engaging part 9 deform elastically and restore the original shapes to achieve engagement between the engaging part 8 and the partner engaging part 9.

To attach the male member 1 to fabric 10, the stud 6 is put on a surface (front surface) of the fabric 10 while the cap 4 having the caulking leg 3 is put on the other surface (back surface) of the fabric 10. While maintaining this state, the caulking leg 3 is pushed through the fabric 10 and the fabric 10 is firmly held between the stud 6 and the cap 4. The caulking leg 3 penetrating the fabric 10 is inserted into the insertion hole 5 of the stud 6. Subsequently, the end of the caulking leg 3 is crushed and caulked with a fixing tool (such as punch), which is not included in the diagrams, so that the male member 1 is fixed to the fabric 10. The procedure for fixing the female member 2 to fabric 10 is not described in detail here, but it is carried out similarly to procedure for fixing the male member 1 by putting the socket 7, instead of the stud 6, on the other surface (back surface) of the fabric 10. The caps 4 of the male member 1 and the female member 2 are required to be high in stiffness so that the caulking leg 3 can penetrate the fabric 10 and also required to be high enough in toughness to deform without suffering from cracking when caulked. On the other hand, the stud 6 of the male member 1 and the socket 7 of the female member 2 are required to be high in toughness so that they can be fastened and unfastened repeatedly.

The resin composition to be used to produce the snap fastener according to the present invention preferably contains 45 to 100 parts by weight of wollastonite (B1), used as inorganic filler (B), per 100 parts by weight of polyamide resin (A). The inclusion of polyamide resin (A) serves to produce a snap fastener with high heat resistance. The inclusion of wollastonite (B1), on the other hand, serves to produce a snap fastener having stiffness and toughness in a good balance and suffering from little stiffness deterioration attributable to water absorption.

There are no specific limitations on polyamide resin (A) to be used for the present invention, and useful materials include polyamide resins produced from lactams such as ϵ-caprolactam, undeca lactam, dodeca lactam, and enatholactam; polyamide resins produced from amino acids such as aminocaproic acid, 7-aminoheptane acid, 8-aminooctanoic acid, 9-aminononane acid, 10-aminodecanoic acid, 11-aminoundecanoic acid, and 12-aminododecanoic acid; polyamide resins produced from a diamine, such as tetramethylene diamine, pentamethylene diamine, 2-methyl-1,5-diaminopentane, 3-methyl-1,5-diaminopentane, hexamethylene diamine, heptamethylene diamine, octamethylene diamine, nonamethylene diamine, decamethylene diamine, undecamethylene diamine, dodecamethylene diamine, o-xylylene diamine, m-xylylene diamine, p-xylylene diamine, 1,2-diaminocyclohexane, 1,3-diaminocyclohexane, or 1,4-diaminocyclohexane, combined with a dicarboxylic acid, such as succinic acid, glutaric acid, adipic acid, pimelic acid, suberic acid, 1,7-heptane dicarboxylic acid, sebacic acid, 1,9-nonanedicarboxylic acid, 1,10-decanedicarboxylic acid, 1,11-undecanedicarboxylic acid, terephthalic acid, isophthalic acid, phthalic acid, 1,2-cyclohexanedicarboxylic acid, 1,3-cyclohexanedicarboxylic acid, or 1,4-cyclohexanedicarboxylic acid, and appropriate copolymers of these polyamide resins. Two or more thereof may be contained.

Of these, the use of polyamide 6 resin, polyamide 66 resin, polyamide 6/polyamide 66 copolymer, polyamide 610 resin, polyamide 11 resin, polyamide 12 resin, polyamide 6/polyamide 12 copolymer, polyamide 6/6T copolymer (6T: polyamide unit consisting of hexamethylene diamine and terephthalic acid), polyamide 6/6I copolymer (6I: polyamide unit consisting of hexamethylene diamine and isophthalic acid), polyamide 6/6T/6I copolymer, polyamide 6/6I/66 copolymer, polyamide MXD6 resin (polyamide resin produced from m-xylylene diamine and adipic acid), and polyamide MXD6/66 copolymer is preferable from the viewpoint of moldability. The use of polyamide 66 resin or polyamide 610 resin is more preferably from the viewpoint of moldability as well as heat resistance, stiffness, and toughness of molding products thereof. In particular, the use of polyamide 66 resin is still more preferable as material for the caps which are required to have a high stiffness to penetrate fabric and a high heat resistance to resist the heat of ironing applied to caps fixed on the outer surface of clothes. On the other hand, polyamide 610 resin is used more favorably as material for the socket and stud, which are fastened and unfastened repeatedly and accordingly required to have a high toughness.

There are no specific limitations on the viscosity number of polyamide resin (A) that is used for the present invention, but from the viewpoint of stiffness, toughness and flowability, the viscosity number is preferably in the range of 100 to 170 ml/g, particularly preferably 120 to 150 ml/g. Here, the viscosity number of polyamide resin (A) is measured in compliance with ISO307 using 96% sulfuric acid as solvent.

It is preferred that inorganic filler (B) used for the present invention contain wollastonite (B1). If necessary, it may also contain glass fiber (B2) or other various inorganic fillers that are generally used in combination polyamide resin. From the viewpoint of further improving the toughness, the content of inorganic filler (B) is preferably 100 parts by weight of or less per 100 parts by weight of polyamide resin (A). From the viewpoint of securing a required stiffness, the content is preferably 45 parts by weight of or more per 100 parts by weight of polyamide resin (A).

Wollastonite (B1) used for the present invention is preferably in the form of needle crystals containing calcium silicate as primary component. Here, the primary component refers to the component that accounts for 50 mass % or more, and it accounts for preferably 80 mass % or more, more preferably 90 mass % or more, and still more preferably 95 mass % or more. Generally known wollastonite materials may be used for the present invention. Wollastonite is commonly in the form of white mineral, which may be crushed and classified for use. Due to the crystal structure, crushed material of the mineral is also in a fibrous form. Wollastonite normally contains $SiO_2$ in a content of 40 to 60 mass % and CaO in a content of 40 to 55 mass %, along with other components such as $Fe_2O_3$ and $Al_2O_3$, but there are no specific limitations on them when used for the present invention.

Wollastonite (B1) preferably has an average particle diameter (average fiber diameter) of 0.5 μm or more from the viewpoint of improving the dispersibility in a resin composition and producing molding products with an further improved stiffness. From the viewpoint of the appearance of molding products and abrasion resistance of metal parts of injection molding machines and the like, on the other hand, it is preferably 10 μm or less. The average particle diameter of wollastonite is determined by photographing it with a scanning electron microscope (SEM) at a magnification of ×1,000 to ×50,000 and calculating the number average particle diameter (fiber diameter) of 500 arbitrarily-selected wollastonite particles. If a particle of wollastonite does not have a circular cross section, the largest size across it is taken as its particle diameter.

In a resin composition used for embodiments of the present invention, wollastonite (B1) accounts for 45 to 100 parts by weight per 100 parts by weight of polyamide resin (A). If the content of wollastonite (B1) is less than 45 parts by weight, molding products will fail to have a sufficient stiffness. As it absorbs water, its stiffness decreases because the relative content of polyamide resin (A) increases. The content of wollastonite is preferably 65 parts by weight or more. If the content of wollastonite (B1) is more than 100 parts by weight, on the other hand, molding products will be inferior in toughness. The content of wollastonite is preferably 75 parts by weight or less.

There are no specific limitations on glass fiber (B2), and an appropriate glass fiber material generally used in combination with polyamide resin can be adopted. The inclusion of glass fiber (B2) serves to provide molding products with further improved stiffness. If glass fiber (B2) is contained, its content is preferably 10 parts by weight of or less per 100 parts by weight of polyamide resin (A) from the viewpoint of the balance between toughness and stiffness.

There are no specific limitations on the fiber diameter and length of glass fiber (B2), and favorable ones may be used appropriately. For instance, they include chopped strands with an average fiber diameter of 5 to 30 μm. When using chopped strands, there are no specific limitations on their length or other such properties, and it is preferable to select ones in the range of 0.1 to 6 mm appropriately. To determine the average fiber diameter and average fiber length of glass fiber, it is observed with an optical microscope with a magnification of ×5 to ×10, and the number averages of fiber diameter and fiber length are calculated from measurements taken from arbitrarily-selected 400 glass fibers using an image analysis device.

Glass fiber (B2) preferably carries a sizing agent and silane coupling agent attached on its surface. There are no specific limitations on the sizing agent and silane coupling agent, and generally known ones may be used. They can improve the adhesion force between the polyamide resin and glass fiber.

Of the resin compositions usable for embodiments of the present invention, at least the resin composition that forms the cap of either the male member or the female member contains 45 to 100 parts by weight of wollastonite (B1) and 1 to 10 parts by weight of glass fiber (B2) per 100 parts by weight of polyamide 66 resin (A1). It is more preferable for both the cap of the male member and the cap of the female member to be produced by molding a polyamide 66 resin (A1) based composition. If the content of wollastonite (B1) is less than 45 parts by weight, molding products will fail to have a sufficient stiffness. As a cap absorbs water, its stiffness decreases because the relative content of polyamide resin (A) increases. The content of wollastonite is more preferably 65 parts by weight or more. If the content of wollastonite (B1) is more than 100 parts by weight, on the other hand, molding products will be inferior in toughness. The content of wollastonite is preferably 75 parts by weight or less.

Moreover, molding products will have further improved stiffness if glass fiber (B2) accounts for 1 part by weight or more per 100 parts by weight of polyamide 66 resin (A1). The glass fiber content is more preferably 2 parts by weight of or more. On the other hand, molding products will maintain a higher level of toughness if the content of glass fiber (B2) is 10 parts by weight or less.

Of the resin compositions usable for embodiments of the present invention, at least the resin composition used to produce either the socket of the female member or the stud of the male member preferably contains 45 to 100 parts by weight of wollastonite (B1) per 100 parts by weight of polyamide 610 resin (A2). It is more preferably for both the socket of the female member and the stud of the male member are produced by molding a polyamide 610 resin (A2) based composition. If the content of wollastonite (B1) is less than 45 parts by weight, molding products will fail to have a sufficient stiffness. As they absorb water, their stiffness decreases because the relative content polyamide resin (A) increases. The content of wollastonite is more preferably 65 parts by weight or more. If the content of wollastonite (B1) is more than 100 parts by weight, on the other hand, molding products will be inferior in toughness. The content of wollastonite is preferably 75 parts by weight or less. In the resin compositions used to produce the socket and the stud, glass fiber (B2) preferably accounts for as small a proportion as possible and more preferably it is not contained.

The resin composition according to the present invention may contain other components unless they impair the effect of the invention. Such other components include, for instance, antioxidant agents and heat-resistance stabilizers (such as hindered phenol based, hydroquinone based, and phosphite based ones, and substitution products thereof), weathering stabilizers (such as resorcinol based, salicylate based, benzotriazole based, benzophenone based, and hindered amine based ones), mold release agents and lubricants (such as montanic acids, metal salts thereof, esters thereof, and half esters thereof, as well as stearyl alcohols, stearamide, various bisamides, bisurea, and polyethylene wax), pigments (such as cadmium sulfide, phthalocyanine, and carbon black), dyes (such as nigrosine), crystal nucleating agents (such as talc, silica, kaolin, and clay), plasticizers (such as octyl p-oxybenzoate, and N-butyl benzene sulfone amide), antistatics (such as alkyl sulfate type anionic antistatics, nonionic antistatics such as polyoxy ethylene sorbitan monostearates, and betaine based amphoteric antistatics), flame retardants (such as red phosphorus, melamine cyanurate, hydroxides such as magnesium hydroxide, aluminum hydroxide, ammonium polyphosphate, brominated polystyrene, brominated polyphenylene ether, brominated polycarbonate, brominated epoxy resin, and combinations of these bromine based flame retardants with antimony trioxide), and other polymers.

There are no specific limitations on the method to be used to prepare such a resin composition including polyamide resin (A) and inorganic filler (B) containing wollastonite (B1), and preferable methods include, for instance, the use of a melt kneading machine such as single- or twin-screw extruder, bunbary mixer, and mixing rol. Of these, the use of a twin-screw extruder is preferred. When melt-kneading is performed using a twin-screw extruder, the useful procedures include blending polyamide resin (A) and inorganic filler (B) using a blender in advance, and subsequently supplying the mixture through a main feeder; supplying polyamide resin (A) through the main feeder while supplying inorganic filler (B) through the side feeder at the end of the extruder; and melt-kneading polyamide resin (A) in advance, and subsequently melt-kneading it with inorganic filler (B). The melt kneading machine to be used may be provided with deaeration equipment (vent).

Generally known methods may be used to mold the snap fastener according to the present invention. For example, the useful methods include, but not limited to, extrusion molding, injection molding, injection compression molding, blow molding, and press molding, of which injection molding is preferable from the viewpoint of productivity.

EXAMPLES

The present invention will now be illustrated in detail below with reference to Examples, but it should be understood that the invention is not construed as being limited to Examples given below.

<Raw Materials>

The resins 1 to 10 described below were prepared as materials for snap fasteners. (Resins 1-9) Polyamide 66 resin (A1) ("Amilan" (registered trademark) E3001, supplied by Toray Industries, Inc.; viscosity number 135 ml/g), polyamide 610 resin (A2) ("Amilan" CM2001, supplied by Toray Industries, Inc.; viscosity number 135 ml/g), wollastonite (B1) (FPW-400S, supplied by Kinsei Matec Co., Ltd.; average particle diameter 8 μm), and glass fiber (B2) (GAFT742, supplied by Owens Corning Corporation, average fiber diameter 9.5 μm, average fiber length 3.0 mm) were used in the proportions shown in Table 1, in combination with a TEM-58 twin-screw extruder supplied by Toshiba Machine Co., Ltd. Polyamide resin (A), supplied from the feed port on the upstream side, and wollastonite (B1) and/or glass fiber (B2), supplied from the feed port on the downstream side, were melt-kneaded at a resin melting temperature of 280° C. and screw rotation speed of 200 rpm, and then pelletized.

TABLE 1

| | components (parts by weight) | | | |
|---|---|---|---|---|
| | polyamide 66 resin (A1) | polyamide 610 resin (A2) | wollastonite (B1) | glass fiber (B2) |
| resin 1 | 100 | 0 | 70 | 0 |
| resin 2 | 100 | 0 | 70 | 9 |
| resin 3 | 0 | 100 | 70 | 0 |
| resin 4 | 0 | 100 | 70 | 9 |
| resin 5 | 100 | 0 | 0 | 0 |
| resin 6 | 100 | 0 | 17 | 0 |
| resin 7 | 100 | 0 | 150 | 0 |
| resin 8 | 100 | 0 | 0 | 17 |
| resin 9 | 100 | 0 | 35 | 0 |

(Resin 10): Polyacetal resin ("Tenac" (registered trademark) 4010, supplied by Asahi Kasei Corporation)

<Molding>

Resins 1 to 10 were prepared and injection-molded using an injection molding machine (SE30D, supplied by Sumitomo Heavy Industries, Ltd.) to produce caps (maximum outside diameter 7 mm, height 2.5 mm) and sockets/studs (maximum outside diameter 7 mm, height 2.5 mm).

<Evaluation Methods>

(1) Heat Resistance

A woven tape with a thickness of 2 mm is prepared as fabric. A male member 1 was fixed to this woven tape using a common fixing tool. An iron with a cord (TA-GX110, supplied by Toshiba Corporation), set to a temperature setting of "high (about 200° C.)", was put on the cap of the male member 1 to heat it for one minute, followed by observing its conditions. A total of 100 test pieces were tested and evaluation was conducted according to the following criteria based on the defective fraction.

◎ (excellent): all 100 test pieces are free of deformation.

○ (good): 1 to 10 test pieces suffer from deformation.

x (inferior): 11 to 100 test pieces suffer from deformation.

(2) Fabric Penetrability

A woven tape with a thickness of 2 mm is prepared as fabric. When fixing the male member 1 to the woven tape using a common fixing tool, observation is performed to check if the caulking leg 3 can penetrate the fabric 10. If low in stiffness, it fails to penetrate the fabric. A total of 100 test pieces were tested and evaluation was conducted according to the following criteria based on the defective fraction.

◎ (excellent): All 100 caulking legs 3 penetrate the fabric.

○ (good): 1 to 10 caulking legs 3 break without penetrating the fabric.

x (inferior): 11 to 100 caulking legs 3 break without penetrating the fabric.

(3) Fitting Strength

A woven tape with a thickness of 2 mm is prepared as fabric. A male member 1 was fixed to this woven tape using a common fixing tool. After fixing the stud and cap of the male member 1 to the fabric 10, a load of 98 N was applied in the direction for pulling them apart and then observation is performed to check for destruction or removal. The fitting strength will be low if their stiffness and toughness are low. A total of 100 test pieces were tested and evaluation was conducted according to the following criteria based on the defective fraction.

◎ (excellent): All 100 test pieces were free of destruction or removal under a pulling load of 98 N.

○ (good): 1 to 10 test pieces suffer from destruction or removal.

x (inferior): 11 to 100 test pieces suffer from destruction or removal.

(4) Shape of Caulked Parts

A woven tape with a thickness of 2 mm is prepared as fabric. A male member 1 was fixed to this woven tape using a common fixing tool. After crushing the caulking leg 3 of the male member 1, their conditions are observed (to check for cracks and flaws). If low in toughness, they are likely to suffer from cracks and flaws. A total of 100 test pieces were tested and evaluation was conducted according to the following criteria based on the defective fraction. In the case of the samples for which 11 to 100 test pieces failed to penetrate the fabric in the fabric penetrability evaluation under (2), a hole is made in the fabric 10 in advance and the caulking leg 3 was inserted through it and then crushed.

◎ (excellent): All 100 test pieces are free of cracks or flaws.

○ (good): 1 to 10 test pieces suffer from cracks or flaws.

x (inferior): 11 to 100 test pieces suffer from cracks or flaws.

(5) Attaching and Detaching (Repeated)

A woven tape with a thickness of 2 mm is prepared as fabric. A male member 1 and a female member 2 were fixed to this woven tape using a common fixing tool. Attaching and detaching (engaging and disengaging) of the male member 1 and the female member 2 were performed 1,000 times repeatedly. Observation was conducted to check if the attaching and detaching of the male member 1 and the female member 2 performed 1,000 times repeatedly cause their deformation and make them unable to be engaged or disengaged any more. If low in toughness and stiffness, they will be unable to resist repeated straining and undergo deformation. A total of 100 test pieces were tested and evaluation was conducted according to the following criteria based on the defective fraction.

◎ (excellent): All 100 test pieces are free of deformation and can be attached and detached satisfactorily after 1,000 times of repeated operation.

○ (good): 1 to 10 test pieces suffer from deformation within 1,000 times of repeated operation and become unable to be attached and detached.

x (inferior): 11 to 100 test pieces suffer from deformation within 1,000 times of repeated operation and become unable to be attached and detached.

Examples 1, 3, 5, 7, and 9

Caps, sockets, and studs were produced from resins 1 to 4 and subjected to the aforementioned tests. Results are given in Table 2.

Example 2, 4, 6, 8, and 10

Caps, sockets, and studs were produced from resins 1 to 4 and the resulting caps, sockets, and studs were subjected to the aforementioned tests after undergoing water absorption treatment (left to stand for 14 days in an environment at a room temperature of 35° C. and humidity of 80%). Results are given in Table 2. In the table, the resins of the caps, sockets, and studs that had undergone water absorption treatment are represented as resins 1(*) to 4(*).

Comparative examples 1, 3, 5, 7, 9, and 11

Caps, sockets, and studs were produced from resins 5 to 10 and subjected to the aforementioned tests. Results are given in Table 3.

Comparative examples 2, 4, 6, 8, 10, and 12

Caps, sockets, and studs were produced from resins 5 to 10 and the resulting caps, sockets, and studs were subjected to the aforementioned tests after undergoing water absorption treatment (left to stand for 14 days in an environment at a room temperature of 35° C. and humidity of 80%). Results are given in Table 3. In the table, the resins of the caps, sockets, and studs that had undergone water absorption treatment are represented as resins 5(*) to 10(*).

The results given in Tables 2 and 3 show that the snap fastener according to the present invention is high in heat resistance, stiffness, and toughness and small in stiffness deterioration attributable to water absorption, showing good characteristics in snap fastener evaluations.

EXPLANATION OF NUMERALS

1. male member
2. female member
3. caulking leg
4. cap
5. insertion hole

TABLE 2

| | parts | | evaluation | | | | |
|---|---|---|---|---|---|---|---|
| | cap | socket/stud | heat resistance | fabric penetrability | fitting strength | caulked state | Attaching and detaching (repeated) |
| Example 1 | resin 1 | resin 1 | ◎ | ◎ | ◎ | ◎ | ◎ |
| Example 2 | resin 1(*) | resin 1(*) | ◎ | ○ | ○ | ◎ | ◎ |
| Example 3 | resin 2 | resin 2 | ◎ | ◎ | ◎ | ◎ | ○ |
| Example 4 | resin 2(*) | resin 2(*) | ◎ | ◎ | ◎ | ◎ | ◎ |
| Example 5 | resin 3 | resin 3 | ◎ | ○ | ○ | ◎ | ◎ |
| Example 6 | resin 3(*) | resin 3(*) | ◎ | ○ | ○ | ◎ | ◎ |
| Example 7 | resin 4 | resin 4 | ◎ | ◎ | ◎ | ◎ | ◎ |
| Example 8 | resin 4(*) | resin 4(*) | ◎ | ○ | ○ | ◎ | ◎ |
| Example 9 | resin 2 | resin 3 | ◎ | ◎ | ◎ | ◎ | ◎ |
| Example 10 | resin 2(*) | resin 3(*) | ◎ | ◎ | ◎ | ◎ | ◎ |

(*)water absorption treatment (35° C., 80%, 14 days)

TABLE 3

| | parts | | evaluation | | | | |
|---|---|---|---|---|---|---|---|
| | cap | Socket/stud | heat resistance | fabric penetrability | fitting strength | caulked state | Attaching and detaching (repeatedly) |
| Comparative example 1 | resin 5 | resin 5 | ◎ | X | —*1 | ◎*2 | ◎ |
| Comparative example 2 | resin 5(*) | resin 5(*) | ◎ | X | —*1 | ◎*2 | ◎ |
| Comparative example 3 | resin 6 | resin 6 | ◎ | X | —*1 | ◎*2 | ◎ |
| Comparative example 4 | resin 6(*) | resin 6(*) | ◎ | X | —*1 | ◎*2 | ◎ |
| Comparative example 5 | resin 7 | resin 7 | ◎ | ◎ | X | X | X |
| Comparative example 6 | resin 7(*) | resin 7(*) | ◎ | ◎ | X | X | X |
| Comparative example 7 | resin 8 | resin 8 | ◎ | ◎ | X | X | X |
| Comparative example 8 | resin 8(*) | resin 8(*) | ◎ | X | X | X*2 | X |
| Comparative example 9 | resin 9 | resin 9 | ◎ | ○ | ○ | ◎ | ◎ |
| Comparative example 10 | resin 9(*) | resin 9(*) | ◎ | X | X | ◎ | ◎ |
| Comparative example 11 | resin 10 | resin 10 | X | ◎ | ◎ | ◎ | ◎ |
| Comparative example 12 | resin 10(*) | resin 10(*) | X | ◎ | ◎ | ◎ | ◎ |

(*)water absorption treatment (35° C., 80%, 14 days)
*1 not measured
*2 a hole made in fabric for evaluation

6. stud
7. socket
8. engaging part
9. partner engaging part
10. fabric

The invention claimed is:

1. A snap fastener comprising a female member composed mainly of a cap with a crushable caulking leg and a socket with an insertion hole for the caulking leg and a male member composed mainly of a cap with a crushable caulking leg and a stud with an insertion hole for the caulking leg, wherein the cap of the male member and/or the cap of the female member are produced by molding a resin composition comprising 45 to 100 parts by weight of wollastonite and 1 to 10 parts by weight of glass fiber per 100 parts by weight of polyamide 66 resin, and wherein the socket of the female member and/or the stud of the male member are produced by molding a resin composition comprising 45 to 100 parts by weight of wollastonite per 100 parts by weight of polyamide 610 resin.

2. The snap fastener of claim 1, wherein the socket of the female member and/or the stud of the male member are produced by molding a resin composition comprising 65 to 75 parts by weight of wollastonite per 100 parts by weight of polyamide 610 resin.

3. A snap fastener comprising a female member composed mainly of a cap with a crushable caulking leg and a socket with an insertion hole for the caulking leg and a male member composed mainly of a cap with a crushable caulking leg and a stud with an insertion hole for the caulking leg, wherein the cap of the male member and/or the cap of the female member are produced by molding a resin composition comprising 45 to 100 parts by weight of wollastonite and 1 to 10 parts by weight of glass fiber per 100 parts by weight of polyamide resin, and wherein the socket of the female member and/or the stud of the male member are produced by molding a resin composition that excludes glass fiber and comprises 45 to 100 parts by weight of wollastonite per 100 parts by weight of polyamide resin.

* * * * *